United States Patent [19]

Müller et al.

[11] 4,320,561

[45] Mar. 23, 1982

[54] HOOK, ESPECIALLY SAFETY LOAD HOOK

[75] Inventors: Anton Müller, Aalen-Unterkochen; Peter Kromer, Aalen-Hofherrnweiler, both of Fed. Rep. of Germany

[73] Assignee: Eisen- und Drahtwerk Erlau Aktiengesellschaft, Aalen, Fed. Rep. of Germany

[21] Appl. No.: 103,629

[22] Filed: Dec. 14, 1979

[30] Foreign Application Priority Data

Dec. 16, 1978 [DE] Fed. Rep. of Germany ..... 2854528

[51] Int. Cl.[3] ..... A44B 13/02; B66C 1/36

[52] U.S. Cl. ..... 24/241 PS; 294/82 R

[58] Field of Search ..... 24/241 R, 230.5, 234, 24/232 R, 233, 235, 241 P, 241 PS, 241 SL, 241 SB, 242; 294/82 R

[56] References Cited

U.S. PATENT DOCUMENTS

| | | | |
|---|---|---|---|
| 1,505,051 | 8/1924 | Lindgren | 24/241 PS |
| 1,508,705 | 9/1924 | Maman | 24/241 PS |
| 1,533,995 | 4/1925 | Lang | 24/241 PS |
| 2,561,017 | 7/1951 | Garrison | 24/232 |

FOREIGN PATENT DOCUMENTS

| | | | |
|---|---|---|---|
| 22233 | 7/1882 | Fed. Rep. of Germany | 24/235 |

*Primary Examiner*—Alexander Grosz

*Attorney, Agent, or Firm*—Becker & Becker, Inc.

[57] ABSTRACT

A hook, especially a safety load hook, with a hook body having a receiving opening for a chain link to be suspended therein. The hook body surrounds a fork head with a closure element that closes the receiving opening. The fork head is pivotally arranged on the hook body, and the closure element is held in a closure position at the free hook mouth end through the intervention of a blocking device.

17 Claims, 11 Drawing Figures

HOOK, ESPECIALLY SAFETY LOAD HOOK

The present invention relates to a hook, especially a safety load hook with a hook body having a receiving opening for a chain link or member to be suspended. The hook body encompasses a fork head with a closure element that closes the receiving opening.

Hooks are known, according to which the receiving opening is made smaller by a closure piece which provides a remaining opening having a size corresponding to the diameter of a chain member. Hereby there is to be avoided that the chain member does not slip out. This is made more difficult by the remaining opening, but does not completely preclude such slipping out. Furthermore, hooks are known with which the closure piece is embodied as a flap, which is held under spring force in a position closing the receiving opening. Since the flap in closing position extends over the entire width of the receiving opening, whereas in the opening position however the flap is to engage tightly against the hook body, the flap is relatively flat and long, so that the flap can take up or withstand only nominal tensile load or stress.

It is therefore an object of the present invention to provide a hook of the aforementioned type which automatically closes under tensile or tension loading, and an automatic opening thereof is precluded. Furthermore, the hook is to be capable of being opened by a safety device.

These and other objects and advantages of the present invention will appear more clearly from the following specification in connection with the accompanying drawings, in which.

The hook of the present invention is characterized primarily in that the fork head is pivotably arranged on the hook body, and the closure element is held in a closing position at the free hookmouth end by an intermediately connected blocking device. Further features of the invention include the arrangement of the pivot shaft between the hook body and fork head upon a longitudinal middle axis extending between the force application points of the hook. Also, the hook body may be provided with a U-shaped receiving portion for pivotally receiving the fork head, the fork head being held between the legs or arms of the U-shaped receiving portion. The fork head may have a crosspiece between its head piece and the closure element, which crosspiece is provided with a bore for the pivot shaft. The crosspiece may have limiting surfaces toward the head piece as well as toward the closure element; the limiting surfaces are embodied to extend toward the hook end or tip (hook mouth end). The closure element may be embodied having a tongue form, and at its free tongue end has a formed-out portion directed toward the curvature of arc of the hook mouth end. The recess or formed-out portion corresponds to the curvature of the hook mouth end located across therefrom. The closure element toward its free end may be embodied having a wedge form. The blocking device may be held in the hook body, and in the closure position of the closure element is in engagement therewith by way of a catch. The blocking device may also be held in the closure element, and in the closure position of the closure element is in engagement with the hook body by way of a catch. The blocking device may comprise a spring loaded bolt which is displaceably journalled in a guide. The bolt, towards its free end, may be embodied having a conical form. The catch in the hook body or in the fork head comprises a depression or recess, such as a bore, notch or groove. The catch is located across from the bolt during the closure position of the closure element. A setting or adjustment element for latching and opening the closure element may be arranged on the blocking device. The closure element may comprise a slide, which is connected with the bolt by a connection part and which serves for axial displacement or shifting of the bolt. The slide is arranged externally of the hook. The closure element is held by the blocking device in engagement with the hook mouth end, and the position of the closure element to the hook mouth end serves as a measure for the load capability of the hook.

Figure 3:
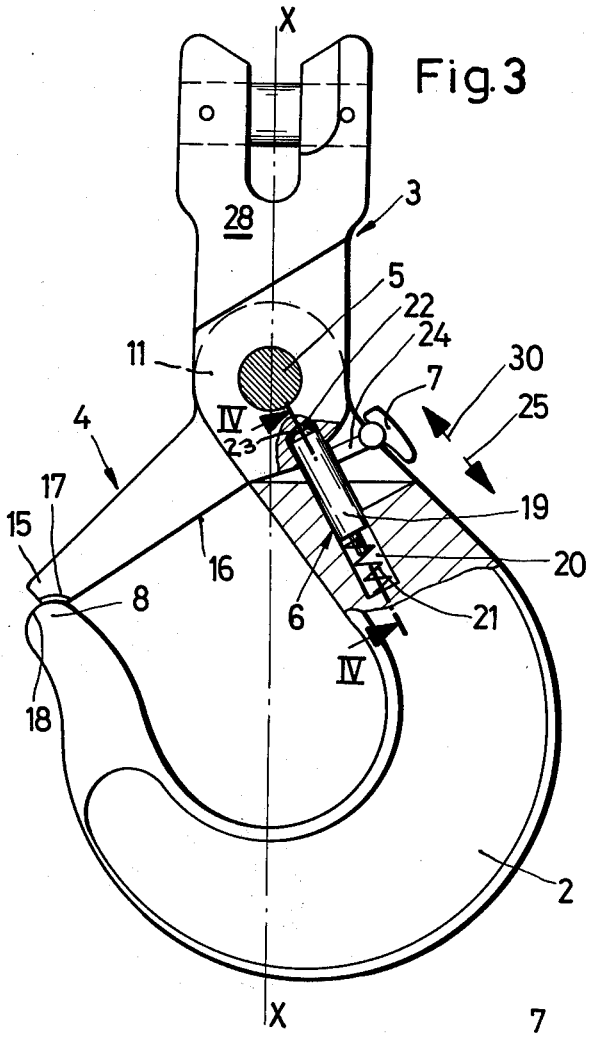
FIG. 3 is a side view of a hook with a blocking device in a hook body and an adjustment device.
Figure 4:
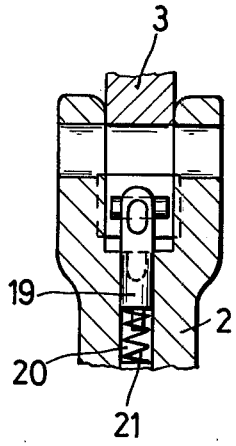
FIG. 4 is a section taken along line IV—IV of FIG. 3.
Figure 6:
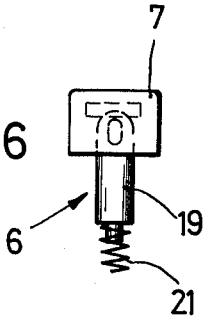
FIG. 6 is a front view of the illustration of FIG. 5.
Figure 5:
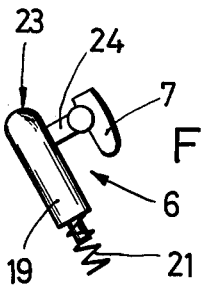
FIG. 5 is a side view of the adjustment element of FIG. 3 on the blocking device.

Referring now to the drawings in detail, the hook 1 surrounds a hook body 2 and a fork head 3. The fork head 3 is provided with a closure element 4. The hook body 2 and the fork head 3 are pivotally connected with each other about an axis or shaft 5. Between both hook parts 2 and 3 there is arranged a blocking or locking device 6, which is capable of being actuated by an adjustment element 7 in the form of a slide (FIG. 3). In the closed condition of the hook 1, the closure element 4 is secured by the blocking device 6 and lies directly at the hook mouth end 8. The opening of the hook 1 occurs manually by way of the adjustment or setting element 7 in that the blocking device 6 is released.

Figure 8:
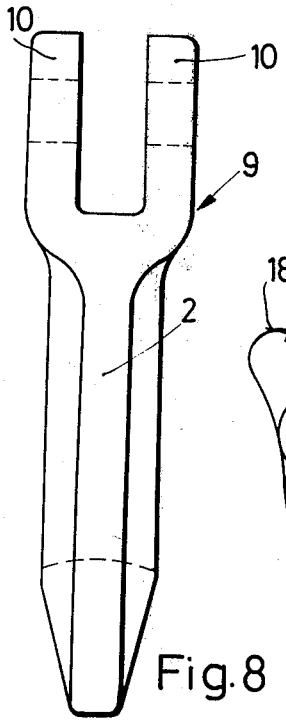
FIG. 8 is a front view of the hook body.
Figure 7:
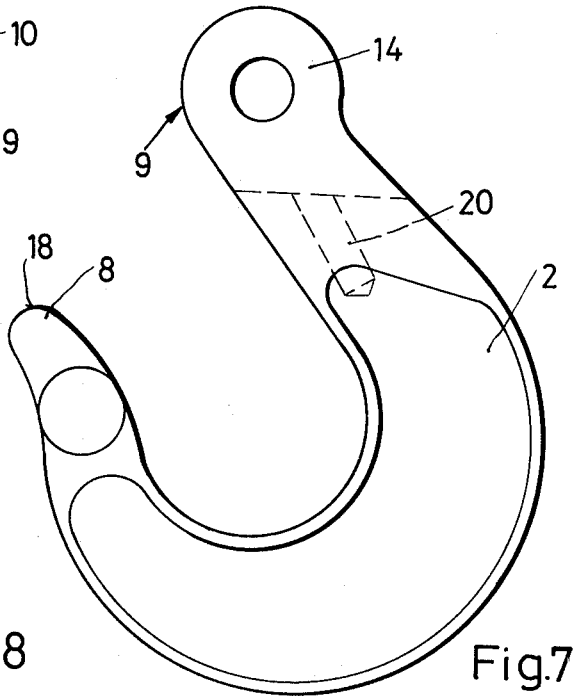
FIG. 7 is a side view of the hook body.

The hook body 2, for the purpose of pivotally receiving the fork head 3 in the embodiment according to FIGS. 3, 7 and 8, has a U-shaped end part 9, between the arms or legs 10 of which the fork head 3 is held. The fork head 3 is provided with a corresponding web portion or crosspiece 11 for this purpose. Both hook parts 2 and 3 are connected with each other by the shaft 5, which has a position between the hook body 2 and the fork head 3, which is arranged upon a longitudinal middle axis X—X extending between the force application points of the hook 1. In this way, the closure element 4 is always drawn into a closed position during pulling or tension loading.

Figure 10:
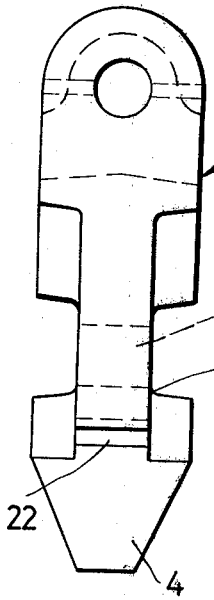
FIG. 10 is a rear view of the closure element.
Figure 9:
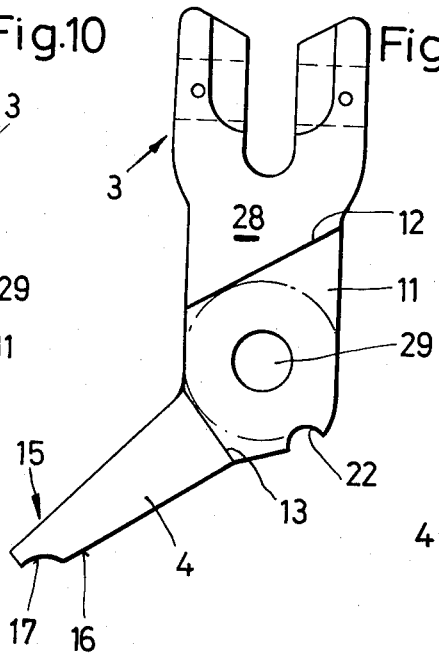
FIG. 9 is a side view of the closure element.
Figure 11:
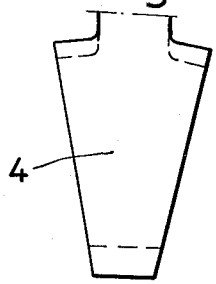
FIG. 11 is a front view of the tongue-shaped end part of the closure element.

As shown more closely in FIGS. 9 and 10, the web part 11 of the fork head 3 is limited by surfaces 12 and 13, which are embodied having a wedge form extending in a direction toward the hook mouth end 8. The head 14 (FIG. 7) of the hook body 2 additionally can engage or be supported on the surfaces 12 and 13.

The closure element 4 of the fork head 3 is embodied in a tongue form and is bent-off with respect to the fork head piece 28. The closure element 4 is pointed or has a tip in the wedge form in the width and thickness thereof toward the free end 15. At the under surface 16 of the closure element 4, there is provided a recess or forming-out 17 which is directed towards the hook mouth end 8 and corresponds to the arc or curvature 18 of the hook mouth end 8 located across therefrom.

Figure 1:
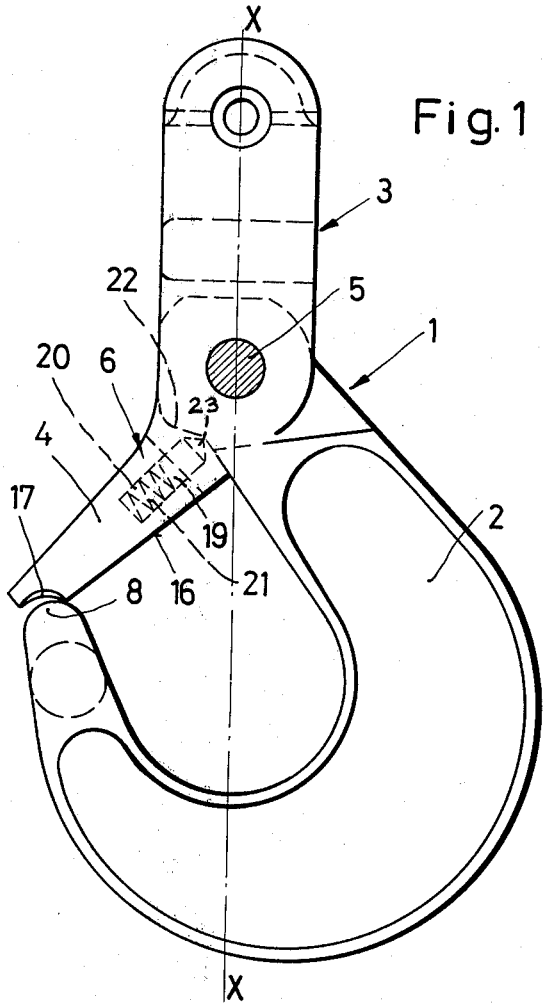
FIG. 1 is a side view of a hook with a blocking device in the closure element.
Figure 2:
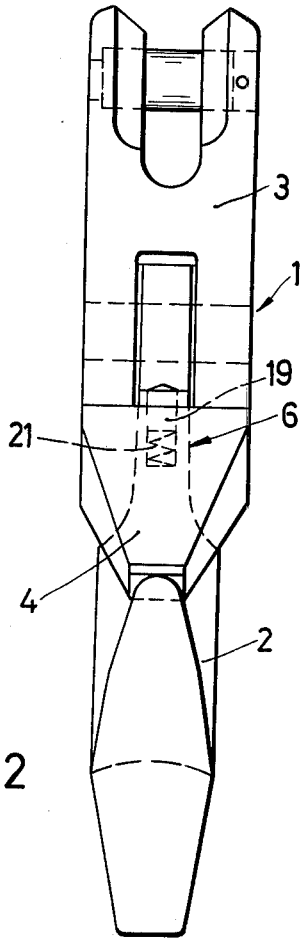
FIG. 2 is a front view of the hook of FIG. 1.

The blocking device 6 can be journalled in the closure element 4 and also in the hook body 2 according to the embodiments and features shown by FIGS. 1 and 3. With the embodiment according to FIGS. 1 and 2, the fork head 3 is provided with a U-shaped receiving means, by which the hook body 2 is received or taken up. The effect of this embodiment is identical to that with the embodiment according to FIG. 3.

The blocking device 6 comprises a bolt 19 which is arranged in a guide 20 of the hook 1; according to FIG. 1, in the closure element 4 of the fork head 3, and according to FIG. 3, in the hook body 2. The bolt 19 is subjected to the pressure of a spring 21, which presses the bolt 19 into a closure position in a catch 22 of the fork head 3 or the hook body 2. This catch 22 can consist of a bore (FIG. 3) or a groove or notch (FIG. 1). The bolt 19 is embodied having a conical form toward the free end, whereby the front bolt region 23 is rounded-off or can also be provided with a tip or point.

As shown in greater detail by the embodiment according to FIG. 3, the blocking device 6 is provided with the adjustment or setting element 7, by means of which an axial shifting of the bolt 19 in the guide 20 is effected. The adjustment element essentially comprises a slide which is fastened on the bolt 19 by a connection part 24. The blocking device 6 is unlatched by exerting pressure in a direction 25. The latching of the hook 1 occurs automatically upon loading, and the bolt moves in a direction 30. The slide 7 is preferably arranged externally of the hook 1 in a manner well accessible for manual actuation. The slide 7 can be provided in the same manner in the embodiment of the hook according to FIG. 1.

The tongue-type closure element 4 is linked or connected to the hook body 2 in such a way that in the closed latch condition, the free end 15 of the closure element 4 engages the hook mouth end 8. In the opened unlatched condition, the closure element 4 occupies such a position that the entire mouth width of the hook 1 is free and open. By the position of the closure element 4 with respect to the hook mouth end 8, there can be recognized, with the hook 1 under load, whether an overload exists, because with the hook 1 under load, the free end 15 of the closure element 4 must always be in engagement with the hook mouth end 8. As soon as a gap of more than one millimeter is visible at this location, the hook 1 is already overloaded.

The advantages attained by the invention are recognizable essentially therein that the hook closes automatically under pulling or tension load, and that an opening is precluded even during removal or depositing of the load. This type of hook is mainly used in economical continuous operation or line-production plants which require multiple lifting and setting down of the load. The opening of the hook can only occur manually by operators by way of the adjustment element, which serves as a safety device.

The present invention is, of course, in no way restricted to the disclosure of the specification and drawings, but also encompasses any modifications within the scope of the appended claims.

What we claim is:

1. A hook, especially a safety load hook, comprising in combination:

a hook body having a receiving opening adapted to receive a chain member therein, said hook body having a free hook-mouth end adjacent said receiving opening;

a fork head pivotally connectible to said hook body and including a crosspiece with a pivot element provided therewith for pivotal connection of said fork head and said hook body crosspiece being provided with limiting surfaces above and below the pivot element, converging toward the free hook mouth end;

a closure element operatively connected to said fork head for closing off said receiving opening; and a blocking device for holding said closure element in a closed position at said free hook-mouth end of said hook body.

2. A hook in combination according to claim 1, in which said hook body has a U-shaped receiving portion for pivotally receiving said fork head, said receiving portion having legs between which said fork head is held.

3. A hook in combination according to claim 1, in which said fork head is provided with a catch, and said blocking device is held in said closer element.

4. A hook in combination according to claim 1, which includes a catch for effecting the holding action of said blocking device, said catch comprising a recess.

5. A hook, especially a safety load hook, comprising:

a hook body having a receiving opening adapted to receive a chain member therein, said hook body having a free hook-mouth end adjacent said receiving opening;

a fork head pivotally connectible to said hook body;

a closure element operatively connected to said fork head for closing off said receiving opening; and a blocking device for holding said closure element in a closed position at said free hook-mouth end of said hook body, said hook body having a U-shaped receiving portion for pivotally receiving said fork head, said receiving portion having legs between which said fork head is held, said fork head having a head piece and a crosspiece, said crosspiece being provided with limiting surfaces toward said head piece and said closure element, with said limiting surfaces extending and converging toward said free hook-mouth end (hook-tip) of said hook body, said fork head including a catch, and said blocking device being arranged in said hook body.

6. A hook according to claim 5, which incudes a pivot shaft for effecting said pivotal connection of said fork head to said hook body, said pivot shaft being located on the longitudinal middle axis extending between the force application points of said hook.

7. A hook according to claim 6, wherein said crosspiece is located between said head piece and said closure element.

8. A hook according to claim 5, in which said free hook-mouth end has a curvature, and in which said closure element is formed as a tongue having a free tongue end which is provided with a formed-out portion directed toward said curvature.

9. A hook according to claim 8, in which said formed-out portion corresponds to said curvature of said hook-mouth end.

10. A hook according to claim 9, in which said closure element extends toward its free end in the shape of a wedge.

11. A hook according to claim 5, which includes a guide and in which said blocking device comprises a spring-loaded bolt which is displaceably journalled in said guide.

12. A hook according to claim 11, in which said bolt has a free conical end.

13. A hook according to claim 5, in which said blocking device includes a spring-loaded bolt, and in which said catch, in the closed position of said hook, is adapted to be located across from said bolt.

14. A hook according to claim 5, in which said blocking device includes an adjustment element for latching and opening said closure element.

15. A hook according to claim 14, in which said blocking device includes a bolt, and in which said adjustment element comprises a slide and a connection part for connecting said adjustment element with said bolt, said slide serving for axial displacement of said bolt.

16. A hook according to claim 15, in which said slide is arranged externally of said hook.

17. A hook according to claim 5, in which said closure element is adapted to be held in engagement with said hook-mouth end by said blocking device.

* * * * *